United States Patent [19]

Semien

[11] 4,418,626

[45] Dec. 6, 1983

[54] ARTICLE TRAY FOR AUTOMOBILES

[76] Inventor: George A. Semien, 2961 Dublin Dr., South San Francisco, Calif. 94080

[21] Appl. No.: 242,956

[22] Filed: Mar. 12, 1981

[51] Int. Cl.[3] ..... A47F 5/12; A47B 9/00

[52] U.S. Cl. ..... 108/8; 108/44

[58] Field of Search ..... 108/8, 44, 45, 46, 47, 108/48; 224/311, 42.43

[56] References Cited

U.S. PATENT DOCUMENTS

| | | | |
|---|---|---|---|
| 356,023 | 1/1887 | Aston | 108/8 |
| 744,113 | 11/1903 | Rye | 224/42.43 |
| 2,253,423 | 8/1941 | Fellers et al. | 224/311 |
| 2,768,043 | 10/1956 | Kristoff et al. | 108/46 |
| 3,015,530 | 1/1962 | Anderson | 108/44 |
| 3,698,330 | 10/1972 | Krombach | 108/44 |
| 3,709,159 | 1/1973 | Oglesby, Jr. | 108/44 |
| 4,168,023 | 9/1979 | Osborn | 108/44 |

*Primary Examiner*—Francis K. Zugel

*Attorney, Agent, or Firm*—Townsend and Townsend

[57] ABSTRACT

An article tray, mountable in the opening of a luggage compartment of an automobile, includes a pair of elongate, longitudinally adjustable leg elements that are pivotally connected proximate the opposing lateral sides of a tray structure. The leg elements adjust lengthwise to extend between opposing peripheral edges of the luggage compartment opening, mounting the tray structure therein.

5 Claims, 2 Drawing Figures

ARTICLE TRAY FOR AUTOMOBILES

The present invention relates to article supporting trays and more particularly to a tray that is removably mounted in the opening of an automobile luggage compartment.

BACKGROUND OF THE INVENTION

Those who frequent such sporting events as football and baseball games, as well as other sports events, are aware of an activity or pastime that has been enjoying an increasing popularity. This activity usually procedes, or at least commences, before the sporting event and takes the form of a party or social gathering held in the parking lot near or adjacent the sporting field or arena. The activity usually involves groups of spectators who travel together to the sporting event, or meet in the parking lot, to enjoy refreshment and social intercourse prior to commencement of the sporting event. Foodstuffs and liquid refreshment are set out on horizontally displaced tailgates of pickups (hence the appelation "tailgate party") or other horizontal surface for the enjoyment of the group. Often there may even be a portable television set, and some of the group may even watch the sporting event on the television set, enjoying the available foodstuffs and liquid refreshment, rather than attending the event in person.

A tailgate is not a requirement for these presporting event activities. However, there is a need for some type of platform, shelf or other horizontal surface on which drink, foofstuffs and even a television set can be placed. Merely using the more horizontal portions of an automobile can result in the finish of the automobile being marred or scratched. Using the automobile's interior can lead to damage of the upholstery. Placing the articles directly on the ground can result in their being inadvertently knocked over, stepped on, or otherwise damage. Carrying portable tables or trays of the type presently available can be cumbersome and, particularly in the case of so-called T.V. trays, at times will provide a support surface that tends to be unstable.

Structures for use by automotive mechanics for holding tools, automotive parts, and the like, or to support the mechanic, are known. Such structures are usually constructed to be mounted proximate the engine compartment. One such structure is specifically intended to cooperatively engage the hood latching mechanism in order to be mounted and, therefore, cannot be used at any other location of the automobile other than the engine compartment. Since most automotive engines tend to be encrusted with grease and other filth, use of this type of structure for supporting foodstuffs has some obvious distasteful aspects associated therewith. Another such structure, also intended to be mounted proximate an automotive vehicle's engine compartment, utilizes a platform that is supported by four individually extendable legs, each leg being pivotally attached at one of their ends to the platform. Not only does the structure require a horizontal surface for each leg to rest upon, but in order to ensure that the platform is horizontal, the length of each leg and the angle at which is pivotally extends from the platform must be adjusted--at best a tedious task. Examples of such structure may be found in U.S. Pat. Nos. 3,015,530 and 3,698,330.

Thus, if one wishes to engage in such pre-sporting event activities, but does not own an automotive vehicle equipped with a tailgate or like device, one is left with some hard decisions.

SUMMARY OF THE INVENTION

Accordingly, the present invention provides a tray that can be removably mountable to an automobile without damage thereto, for supporting a variety of articles and materials. The invention is inexpensive to construct, easy to use, and structured so that it can be carried by an automobile in a minimum amount of space.

According to the present invention, there is provided a pair of elongate, extendable leg elements that are constructed to be mounted in the opening of a luggage compartment of an automobile, extending between opposing portions of the periphery of the opening. The leg elements are pivotally attached to opposing lateral sides of a tray structure by a coupling member that allows each leg element to releaseably pivot relative to the tray structure, and then fixed to inhibit relative movement of the tray structure.

Each terminal end portion of each of the leg elements is structured and configured to firmly engage and rest upon peripheral portions, the respective leg elements extending between opposing portions of the automobile luggage compartment; and it is immaterial whether one opposing portion is vertically located above the other opposing portion. Once the leg elements are set in place, the coupling member is adjusted to orient the tray structure in a horizontal position to ensure that articles set thereupon will remain steady.

A number of advantages can readily be seen to flow from the present invention. Consider: the invention provides structure mountable with an automobile without damage to any of the exposed, finished surface. By providing for mounting the article tray of the present invention to the periphery of the luggage compartment, the change of marring the automobile's finished surfaces is obviated.

The invention is usable in a variety of automobile luggage compartment openings. The longitudinally extendable legs, together with the horizontal adjustment for the tray structure, allows the invention to be mounted to the opposing periphery portions of an automobile luggage compartment opening regardless of any difference in (vertical) levels of the opposing portions or the spacing between them.

Further, the invention is easily used. Minor adjustments to the lengthwise dimension of the legs are easily accomplished in order to mount the invention. The tray structure is then easily adjusted to place it in a horizontal orientation for supporting articles or objects.

In addition, the invention provides structure that is narrow in profile and compact so that it takes up a minimum amount of space when being transported from place to place.

These and further advantages and features of the present invention will be readily seen upon review of the following detailed description of the invention which should be taken in conjunction with the attached drawings.

DETAILED DESCRIPTION OF THE PREFERRED EMBODIMENT

Figure 1:
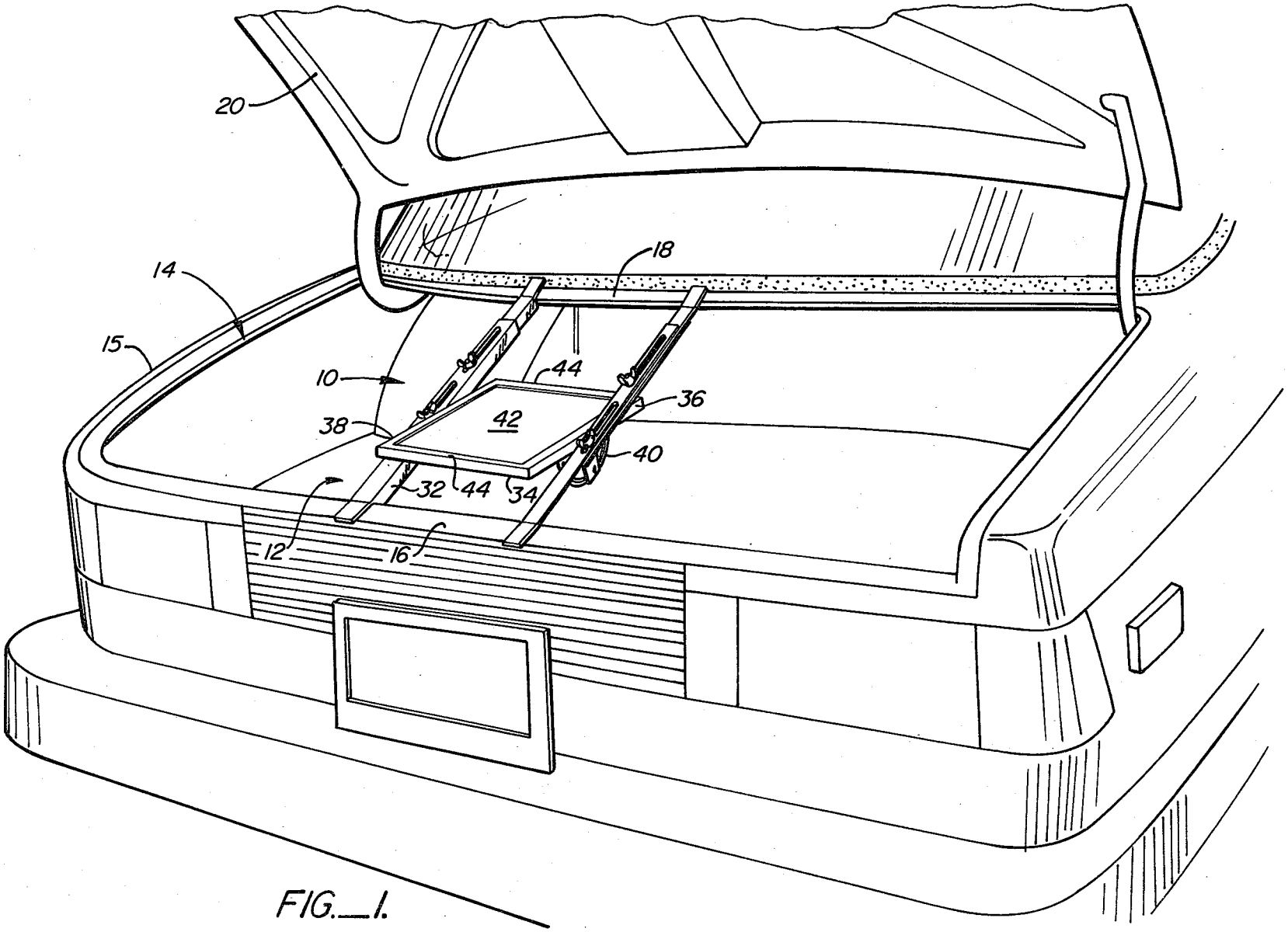
FIG. 1 is a perspective view of the invention, illustrating placement in a luggage compartment opening.

Referring to FIG. 1, the article tray of the present invention, designated by the reference numeral 10, is shown mounted in an opening 12 of a luggage compartment 14 of an automobile 15. The article tray 10 extends from one peripheral portion 16 of the opening 12 to the opposite peripheral portion 18 of the opening 12. The article tray 10 is mounted in the opening 12 after the cover 20 of the luggage compartment 14 is raised, and must be removed before the cover 20 is closed.

The article tray 10 is shown as including a pair of leg elements 30 and 32 that are pivotally connected to a tray structure 34 at opposing lateral edges 36 and 38 thereof by coupling members 40. The tray structure 34, which can be releasably oriented in a horizontal position by the coupling members 40, as will be more fully described below, is provided with a planar upward facing surface 42 that is circumscribed by a rim 44.

Figure 2:
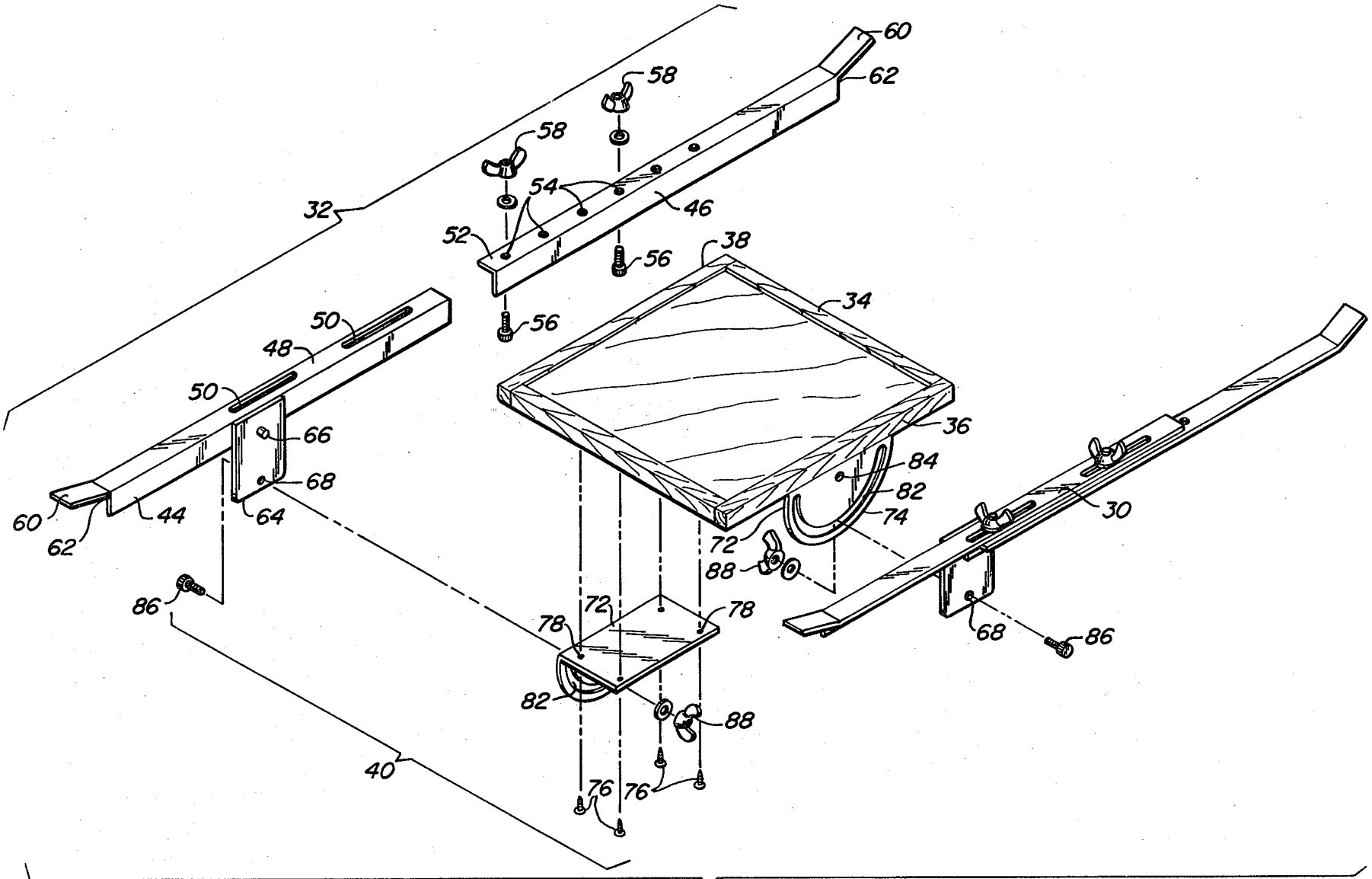
FIG. 2 is another perspective view of the invention depicted in FIG. 1 with portions thereof in exploded configuration, illustrating the component parts thereof.

Each leg element is constructed in identical fashion to the other and, therefore, a description of one of the leg elements 30, 32 will apply equally to the other. Referring then to FIG. 2, leg element 32 is shown as being constructed from a pair of channel members 44 and 46 configured so that the channel member 44 telescopically receives the channel member 46. Formed in a surface 48 of the channel member 44 are elongate, longitudinally extending slots 50; and formed in the top surface 52 of the channel member 46 are threaded apertures 54, positioned to be alignable with the slots 50. Fasteners, such as bolt/wing nut combinations 56/58 are provided, the bolts 56 adapted to be threaded in and extend through the threaded apertures 54 and extend through corresponding slots 50. The leg element 32 is thereby constructed so that it is longitudinally adjustable by merely loosening the wing nuts 58 and relatively shifting the channel members 44 and 46 to lengthen or contract the longitudinal dimension of the leg element 32 as desired.

Formed at each outer end of the leg element 32, at one end of each of the channel members 44, 46, are tabs 60 which extend longitudinally away from and slightly upward of the respective channel members. The tab is structured to form with its respective channel member 44, 46 a "V" shaped notch 62 for receiving the peripheral portions of the automobile luggage compartment opening 12.

Attached to a side 49 of the channel member 44 is a platen 64 which, as will be seen more particularly below, forms a part of the coupling member 40. Affixed to the platen is an outward extending spindle 66, and formed in the platen, below the spindle 66, is an aperture 68.

The remaining portion of the coupling member 40 includes a support plate 72 from which depends, at substantially a right angle thereto, a semicircular portion 74. The support plate 72 mounts to the underside of the tray structure 34, proximate a lateral opposite edge 36, 38 of the tray structure, by conventional fastening apparatus such as fastening bolts or screws 76 which pass through apertures 78 formed in the support plate 72.

The semicircular portion 74 has formed therein an arcuate slot 82 in the shape of an arc of a circle and an aperture 84 formed at what would be the center of circles defining the arcuate slot 82 and the semicircular periphery of the portion 74.

When the coupling member 40 is assembled, the aperture 84 of the semicircular portion 74 forms a bearing that receives the spindle 66 located on the platen 64, thereby allowing the leg element 32 to pivot or rotate about the spindle 66 when attached to the tray structure 34. In addition, the aperture 68 formed in the platen 64 is located so that it is relatively aligned with the arcuate slot 82 during at least a portion of the rotation. A threaded bolt 86 is provided to extend through the arcuate slot 82 and the aperture 68. A wing nut 88 screws onto the threaded portion of the bolt 86 that extends beyond the aperture 86. When the wing nut is tightened, the platen 64 is brought into frictional engagement with the semicircular portion 74 to inhibit relative movement therebetween, thereby releasably fixing the tray structure 34 relative to the leg elements 30, 32.

In use, the individual leg elements 30, 32 are lengthened or shortened, as the case may be, to obtain longitudinal dimension sufficient to allow the leg members 30, 32 to bridge between the opposing peripheral portions 16, 18 of the luggage compartment opening 12. The wing nuts 58 (which were loosened to lengthen or shorten the leg elements) are tightened to secure the channel members 44 and 46 of the leg elements 30, 32 to one another to fix the length so established. The wing nuts 88 of each coupling member 40 are loosened to allow the tray structure 34 to pivot relative to the leg elements 30, 32, until the planar surface 42 is horizontally oriented. The wing nuts 88 are then tightened, bringing the platen 64 into frictional engagement with the semicircular portion 74 of the support plate 72 and inhibiting relative movement between the tray structure 34 and the leg elements 32.

The leg elements and coupling member are preferably fabricated from a light-weight metallic material, aluminum for example, in order that the article tray 10 be capable of supporting heavier objects such as a portable TV set or the like, and yet be light enough to be easily carried. The tray structure 34 can be fabricated from a wood material. If desired, the surface 42 of the tray structure 34 can be provided with either a veneer material, simulating a more expensive wood product, or a pictorial representation to enhance its appearance.

In review, there has been disclosed a tray mountable in the opening of the luggage compartment opening of an automotive vehicle for supporting a variety of objects and elements such as, for example, foodstuffs, portable television or radio sets, and other materials. The invention includes a pair of extendable leg elements that mount to and hold between them a tray structure having a planar surface that is capable of being horizontally positioned with a minimum of effort, once the tray is mounted.

While the above provides a full and complete disclosure of the preferred embodiment of the invention, various modifications, alternate constructions and equivalents may be employed without departing from the true scope and spirit of the invention. For example, the coupling member 40 can utilize a ball and joint configuration so that the leg elements 30 and 32 can pivot relative to the tray structure 34 with three degrees of freedom.

Therefore, the above description and illustrations should not be construed as limiting the scope of the invention which is defined by the appended claims.

I claim:

1. A tray mountable in an opening of a luggage compartment of an automotive vehicle, comprising:

tray structure including a planar outer surface;

a pair of elongate, longitudinally adjustable leg elements, each having an adjusted lengthwise dimension sufficient to extend between confronting peripheral portions of said luggage compartment opening, each leg element terminating in end structure configured to be placed in releasable, holding engagement with the periphery of the luggage compartment opening; and means for pivotally coupling said leg elements to opposing lateral sides of said tray structure and in generally parallel relation to one another, including means for releasably inhibiting relative movement therebetween.

2. The tray of claim 1, the leg elements each including first and second elongate members configured and adapted to slidably engage one another, forming a single longitudinally extending element, and means for releasably connecting said first member to said second member.

3. The tray of claim 1, the coupling means including a pair of first plate members each mounted to said tray structure adjacent the opposite lateral sides thereof, said plate members having portions extending substantially perpendicular therefrom, each portion having formed therein an arcuate slot; a pair of second plate members attached to a corresponding one of said leg elements and pivotally connected to a corresponding one of the first plate members, each second plate member having an aperture formed therein in juxtaposed and aligned relation with said slot; and means, including a bolt extending through each aperture and slot combination, for releasably holding said first and second plates in frictional engagement with one another.

4. The tray of claim 2, each of said first elongate members having a longitudinally extending slot formed therein; and means, including a bolt extending through said aligned slots, for releasably fastening said first elongate member to said second elongate member.

5. The tray of claim 1, said tray structure including a planar surface adapted to face in a vertical direction when said tray is mounted in said luggage compartment opening, and a rim structure formed and circumscribing said planar surface.

* * * * *